United States Patent [19]

Jo

[11] 4,003,822

[45] Jan. 18, 1977

[54] MAIN COLUMN SEPARATION OF FCC PRODUCT EFFLUENT

[75] Inventor: Hong-Kyu Jo, Des Plaines, Ill.

[73] Assignee: UOP Inc., Des Plaines, Ill.

[22] Filed: Jan. 26, 1976

[21] Appl. No.: 652,276

[52] U.S. Cl. ..... 208/102; 208/103; 208/104; 208/105; 208/355

[51] Int. Cl.[2] ..... C10G 37/00

[58] Field of Search ..... 208/102, 103, 104, 105, 208/355

[56] References Cited

UNITED STATES PATENTS

| | | | |
|---|---|---|---|
| 2,398,496 | 4/1946 | Edmister et al. | 208/102 |
| 3,310,487 | 3/1967 | Johnson et al. | 208/355 |
| 3,494,861 | 2/1970 | Munro | 208/103 |

*Primary Examiner*—Herbert Levine
*Attorney, Agent, or Firm*—James R. Hoatson, Jr.; Robert W. Erickson; William H. Page, II

[57] ABSTRACT

Separation of the catalyst-containing product effluent from a fluid catalytic cracking unit is effected in the main column by a technique which involves removing a light naphtha fraction as the single overhead stream and separately withdrawing a heavy naphtha fraction as a lower side-cut. The latter is stripped of light naphtha (for recycle to the main column) and recovered as a product stream. Preferably a portion of the heavy naphtha fraction (as withdrawn) is cooled and combined with the light naphtha overhead reflux stream.

7 Claims, 1 Drawing Figure

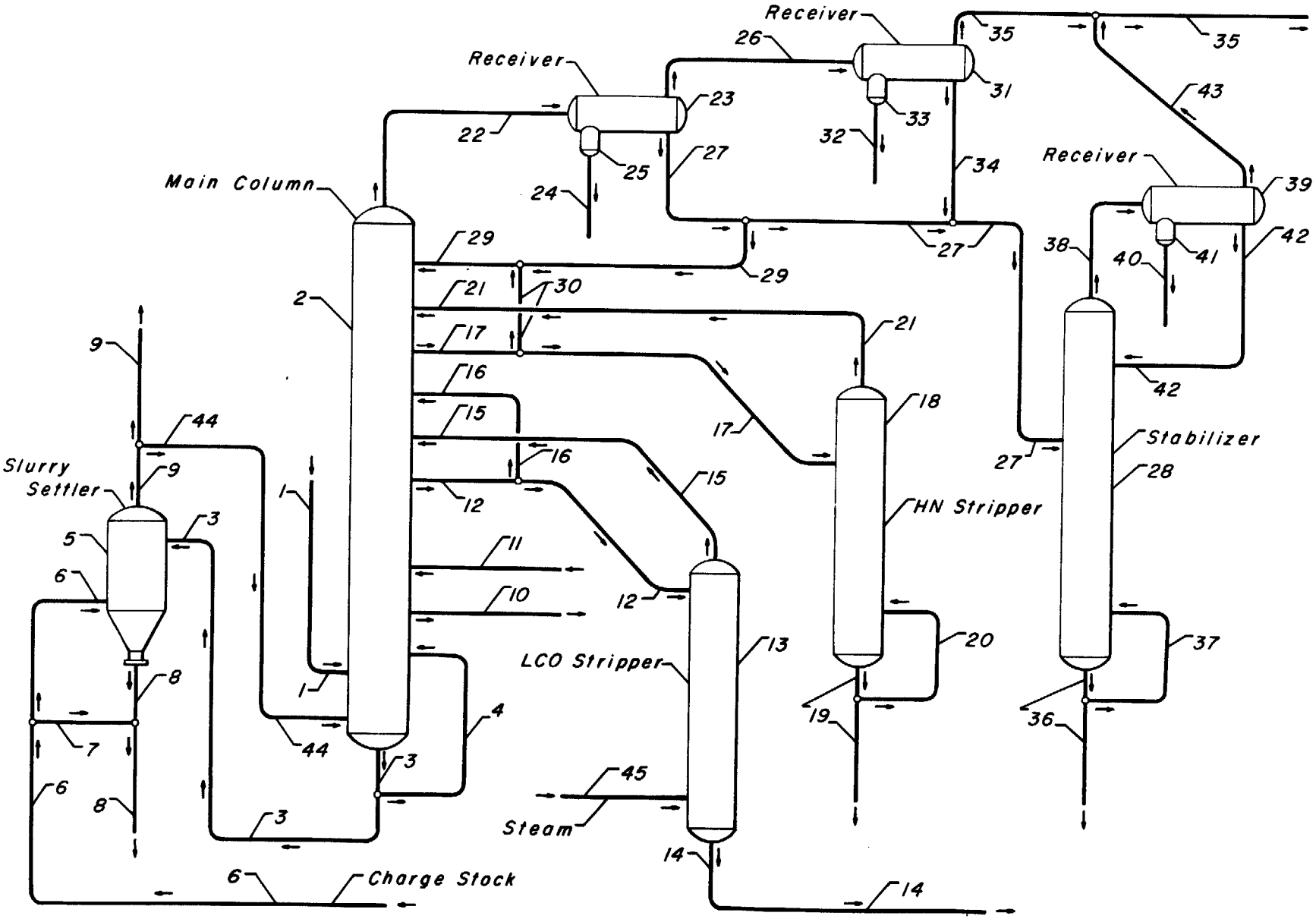
Receiver
Receiver
Receiver
Receiver
Stabilizer
HN Stripper
LCO Stripper
Steam
Charge Stock
Main Column
Slurry Settler

MAIN COLUMN SEPARATION OF FCC PRODUCT EFFLUENT

APPLICABILITY OF INVENTION

As herein described, the present invention directs itself to the well-known fluid catalytic cracking process wherein heavy hydrocarbonaceous charge stocks are converted into lower-boiling hydrocarbons in contact with a finely-divided catalytic composite. More specifically, my inventive concept encompasses a method for effecting the separation of the resulting catalyst-containing, catalytically-cracked product effluent. Fluid catalytic cracking (FCC) technology was developed prior to the institution of "Recommendation 41" (pursuant to Section 12 of Public Law 603), and has since been continually renovated and innovated. In view of approximately 35 years of development, no attempt will be made herein to delineate entirely this area of petroleum refining technology. However, a brief description of a typical present-day FCC process is believed warranted in order that the present advance may be more clearly appreciated.

A conventional fluid catalytic cracking system has integrated therein a reactor vessel, a catalyst stripping zone, a spent catalyst withdrawal line, containing what is commonly referred to as the "spent catalyst slide valve", a spent catalyst regeneration zone, a regenerator standpipe, a regenerated catalyst withdrawal line, containing the "regenerated catalyst slide valve", and a "riser" leading back into the reactor vessel. Other equipment normally includes a charge stock preheater, a regenerating gas (oxygen-containing) heater, a product fractionator, or "main column", and an external boiler to oxidize carbon monoxide to carbon dioxide, recovering the heat so produced in the form of steam.

The charge stock is heated to a selected temperature and enters the riser line wherein it is admixed with varying quantities of one or more recycle streams and hot regenerated catalyst withdrawn from the regenerator. The mixture passes through the riser wherein cracking reactions take place, and into the reactor vessel in which additional reactions are effected. Product effluent vapors are separated from entrained catalyst particles, in a cyclone separator, and passed into the main column for separation into various product streams, one of which is a heavy cycle stock (slurry oil) containing finely-divided catalyst particles. This is passed into a settler for recovery of a clarified oil, the catalyst-containing slurry generally being introduced into the riser. Spent catalyst in the reactor vessel is stripped of hydrocarbon vapors, using steam, nitrogen or other inert gases, and passed into the regenerator through the spent catalyst slide valve. An oxygen-containing regenerating gas is introduced into a lower portion of the regenerator, wherein a fluidized dense phase of spent catalyst provides intersettling contact between the coke-containing catalyst particles and the oxidizing gaseous stream. In an upper portion of the regenerator, a dilute phase zone permits separation of catalyst particles from a flue gas stream. The separation is generally effected through the utilization of centrifugal cyclones which return the catalyst particles to the lower dense phase through the cyclone diplegs, and vent the flue gas to the carbon monoxide boiler. Regenerated catalyst particles are withdrawn from the dense phase, through the regenerated catalyst slide valve, and introduced into the riser.

As hereinabove stated, the present inventive concept encompasses a technique directed toward the main column which is utilized to separate the catalyst-containing, catalytically-cracked product effluent. Heretofore, the overhead vaporous fraction from the main column consisted of normally gaseous hydrocarbons and substantially all the normally liquid hydrocarbons boiling in the gasoline boiling range. Therefore, with respect to the latter, the overhead stream contains pentanes and heavier hydrocarbons having normal boiling points up to about 450° F. (232° C.). In accordance with the present invention, a light naphtha fraction, containing hydrocarbons boiling up to about 280° F. (138° C.), is removed as the overhead fraction, while a heavy naphtha fraction, containing hydrocarbons boiling from about 280° F. (138° C.) to about 450° F. (232° C.), is removed as a side-cut fraction. The light naphtha fraction is condensed and separated to provide a liquid phase, at least a portion of which is recycled to the main column as the overhead reflux stream. The heavy naphtha fraction, which will contain light naphtha hydrocarbons, is stripped of the latter which are reintroduced into the main column, the remainder of the heavy naphtha being recovered as a product; preferably, a portion of the withdrawn heavy naphtha fraction is cooled and combined with the overhead reflux stream for introduction therewith into the main column.

PRIOR ART

The development of fluid catalytic cracking has taken place over the past 35 years; there is, therefore, multitudinous publications, including issued patents, directed toward continuing improvements in the basic process. Any attempt to describe exhaustively the voluminous prior art would necessarily be an exercise in futility; a few examples will suffice. Contrary to the present technique, wherein the naphtha boiling range hydrocarbons are withdrawn as two separate streams from the main column, the prior art indicates a propensity to withdraw the single overhead stream which is introduced into a low-pressure receiver (about 7.0 to about 15.0 psi.) (0.49 to 1.05 kg/sq.cm.) following cooling and condensation thereof. A portion of the liquid is utilized as reflux to the main column, while the remainder is introduced into a stabilizer column. The vapor is passed into a high-pressure receiver (about 50.0 to about 100.0 psi.) (3.51 to 7.03 kg/sq.cm.), the vapor from which is transmitted to a suitable recovery system, while the condensed liquid is also introduced into the stabilizer column. Vapors from the latter are also transmitted to the recovery system, while the liquid portion is introduced into a so-called "rerun" column. The purpose of the latter is to separate the liquid into an overhead light naphtha fraction and a bottoms heavy naphtha fraction.

U.S. Pat. Nos. 3,161,583 (Cl. 208-164), issued Dec. 15, 1964, and 3,206,393 (Cl. 208-164), issued Sept. 14, 1965 both involve inventive concepts which permit regenerator temperatures exceeding 1150° F (620° C.). It will be noted, in both techniques, that a single gasoline, or naphtha boiling range stream is withdrawn as the main column overhead. U.S. Pat. No. 3,458,691 (Cl. 235-151.12), issued July 29, 1969, is particularly directed toward a control system for integration into a fluid catalytic cracking system. Again, a single naphtha boiling range stream is withdrawn from the main column.

U.S. Pat. No. 3,489,673 (Cl. 208-73), issued Jan. 13, 1970, employs a recycled hydrotreated oil to strip hydrocarbons from the partially deactivated catalyst particles. In U.S. Pat. No. 3,849,294 (Cl. 208-162), issued Nov. 19, 1974, the inventive concept involves a catalyst disengaging zone in combination with the slurry settler. U.S. Pat. No. 3,893,905 (Cl. 208-103), issued July 8, 1975, is directed toward the utilization of a differential condenser into which the main column overhead stream is introduced. In all three instances, a single gasoline stream is removed as overhead from the main column.

In summation, the applicable prior art does not appear to be aware of the present inventive concept and does not, therefore, afford the beneficial advantages accorded its utilization. These attendant advantages apply both to newly designed and constructed fluid catalytic cracking systems, resulting in considerable savings on original capital investment, and to the revamp of existing units for the purpose of allowing increased charge stock rate without the need for extensive capital expense for additional equipment.

* * OBJECTS AND EMBODIMENTS * *

A principal object of the present invention is to facilitate the separation of catalyst-containing reaction product effluent from a fluid catalytic cracking system. A corollary objective involves a separation technique which affords significant operating-cost savings with respect to utilities (energy saving).

Another object is to provide a separation technique which permits capital savings involving major equipment investment whether directed toward the construction of a new FCC unit, or the revamp of an existing system for the purpose of increasing the charge stock flow rate.

Therefore, one embodiment of the present invention is directed toward a separation technique for use in a fluid catalytic cracking process, wherein a hydrocarbonaceous charge stock is converted into lower-boiling hydrocarbons in contact with finely-divided catalyst particles, which technique involves the method of separating the catalyst-containing, catalytically cracked product effluent which comprises the steps of: (a) introducing said product effluent into a first fractionation column through a first locus in the bottom portion thereof; (b) withdrawing a light naphtha fraction from a second locus in the upper portion of said column, condensing and separating said light naphtha fraction to provide (i) a first vaporous phase and, (ii) a liquid phase; (c) recycling a first portion of said liquid phase, as a reflux stream, to said first column through a third locus below said second locus, and introducing a second portion into a second fractionation column; (d) separating said second portion to provide (i) a second vaporous phase and, (ii) a light naphtha product stream; (e) withdrawing a heavy naphtha fraction from said first column through a fourth locus below said third locus, and introducing at least a portion thereof into a third fractionation column; (f) separating the portion of said heavy naphtha fraction to provide (i) a heavy naphtha bottoms product stream substantially free from light naphtha and, (ii) a light naphtha containing overhead stream; (g) introducing at least a portion of said overhead stream into said first column through a fifth locus intermediate said third and fourth loci; and, (h) withdrawing a catalyst-containing slurry oil fraction from said first column through a sixth locus below said first locus.

In a preferred embodiment, a portion of the withdrawn heavy naphtha fraction is cooled and combined with said reflux stream for introduction into said first column through said third locus.

Other objects and embodiments, contemplated and encompassed by the present inventive concept, will become evident from the following more detailed description. In one such other embodiment, the first vaporous phase is separated, at an increased pressure, to provide (i) a third vaporous phase and, (ii) a second liquid phase, and the second liquid phase is introduced into said second fractionation column.

SUMMARY OF INVENTION

In essence, the present inventive concept involves separately withdrawing, as a side-cut fraction, heavy naphtha through a locus below that through which a light naphtha reflux stream is returned. As hereinbefore set forth, this is contrasted to the prior art operation of the main column wherein the naphtha fraction, boiling up to about a temperature of 450° F. (232° C.), is withdrawn as a single overhead stream. This total naphtha fraction is introduced, after cooling and condensation, into an overhead receiver. Vaporous material is introduced into a high-pressure receiver and the liquid into a stabilizer column after a portion has been utilized as reflux to the main column. The vapor from the high-pressure receiver is transported to a suitable recovery system, while the condensed liquid is introduced into the stabilizer column. The liquid portion from the latter is introduced into a so-called "rerun" column wherein the liquid is separated into an overhead light naphtha fraction and a bottoms heavy naphtha fraction.

Comparing a new fluid catalytic cracking system, constructed in accordance with the method of the present invention, with that of the prior art as outlined above, the light naphtha fraction is removed as the sole overhead stream from the main column, condensed and introduced into the low-pressure receiver. Since the heavy naphtha is removed as a separate, side-cut stream, the equipment duty relative to the low-pressure receiver (expressed as BTU/hr.) is about 40.0% to about 60.0% less for the same charge stock flow rate to the reactor section. The heavy naphtha is stripped of light naphtha in a fractionation column which need be no larger than the rerun column employed in current units. Furthermore, since the stabilizer serves only to separate vaporous hydrocarbons from the light naphtha, as contrasted to separating vapors from the total naphtha fraction, it can easily be constructed with about 30.0% to about 50.0% less tray area. As hereinbefore stated and as hereinafter set forth in a specific example, my invention is also advantageously employed in revamping an existing FCC unit where increased charge stock flow to the reactor is desired. Except for increasing the size of the fresh charge stock heater, obviously necessitated through an increased flow rate, the major vessels can be used as they exist. Thus, there is no need to revamp, or change the overhead system of the main column to conform to the increased flow rate. The "old" rerun column serves well for stripping light naphtha from the heavy naphtha side-cut, and the existing stabilizer functions acceptably in handling only the recovery of a light liquid naphtha fraction. As with a newly constructed unit, there exists considerable operating savings with respect to the utilities necessary to operate acceptably and efficiently. Other beneficial advantages will be evident to those skilled in the appropriate art from the following more detailed description, particularly in conjunction with the accompanying drawing.

Since the present inventive concept encompasses a technique for separating the catalytically-cracked product effluent into its several desired components, it is understood that the reactor/regenerator section of the FCC system may be designed and function in any suitable fashion as determined by feed properties, desired product components and conversion level. Likewise, the precise reactor/regenerator operating conditions selected are not essential to the method herein described. Typical catalytic cracking conditions include reactor temperatures of about 800° F. (426° C.) to about 1050° F. (565° C.), regenerator temperatures ranging from 1000° F. (538° C.) to about 1350° F. (734° C.), pressures from atmospheric up to about 50 psig. (3.52 kg/sq.cm.), oil to catalyst weight ratios in the range of 1.0:1.0 to about 10.0:1.0 and combined feed ratios of about 1.01:1.0 to about 3.0:1.0. These variables, some of which are independent and some of which are dependent, are adjusted to maintain conversion per pass levels in the range of 30.0% to about 80.0%.

Catalytic cracking reactions are effected in contact with finely-divided catalyst particles which may be amorphous or crystalline in structure. Suitable amorphous catalysts constitute mixtures of silica with other refractory inorganic oxides including alumina, magnesia, titania, strontia, etc. Zeolitic catalysts include faujasite, mordenite, Type X or Type Y sieves, which may be dispersed within an alumina or silica amorphous matrix. With respect to particle size, any given batch of commercially prepared FCC catalyst will have particles distributed in the range of 20 to 150 microns, with the general average particle size approximating 60 microns.

In accordance with the separation technique encompassed by my invention, the catalytically-cracked product effluent, containing about 0.1% to a maximum of about 1.0% by weight of the finely divided catalyst particles, is introduced into the lower portion of the main column; a catalyst-containing slurry oil is withdrawn as a bottoms stream and introduced into a slurry settler. A clarified oil, having an overall boiling range of about 450° F. to 920° F. (232° C. to 493° C.), is recovered and generally utilized as a blend component for bunker-type fuel oil. The settled slurry of catalyst particles is recycled to the reaction zone. At least a portion of the withdrawn slurry oil is cooled and reintroduced into the lower portion of the main column, through a locus above that through which the column feed is introduced. A heavy cycle oil fraction, having a boiling range approximating 500° F. to 745° F. (260° C. to 396° C.), is withdrawn and employed elsewhere in the system as a heat-exchange medium; in some units, the cooled heavy cycle oil is partially recovered as a product, or simply reintroduced in total into the main column to be recovered with the clarified oil.

A light cycle oil fraction, principally containing kerosene boiling range material, about 419° F. to 615° F. (215° C. to 324° C.), is withdrawn, a portion thereof being cooled and reintroduced into the main column as a quasi-reflux stream. The remainder, containing heavy naphtha hydrocarbons, is introduced into a fractionator-type stripping column for removal of the naphtha components; steam is generally employed as the stripping medium. The recovered naphtha, in admixture with steam, is introduced into the main column through a locus intermediate that through which the LCO is withdrawn and that through which the cooled portion is reintroduced.

Naphtha boiling range hydrocarbons, up to about a temperature of 450° F. (232° C.) are recovered through two separate loci. The single overhead stream is a light naphtha fraction containing normally gaseous hydrocarbons and normally liquid hydrocarbons boiling up to a temperature of about 280° F. (138° C.). This stream is condensed and introduced into a low-pressure separator; the recovered liquid phase is in part utilized as reflux to the upper portion of the main column and the remainder is introduced into the stabilizer column. The recovered vaporous phase is increased in pressure, condensed and introduced into a high-pressure separator, the liquid phase from which is also introduced into the stabilizer; the vaporous phase from this separator is transported to a light end recovery facility. A heavy naphtha fraction, containing some light naphtha hydrocarbons, is withdrawn from a locus below that through which the overhead reflux is returned. In a preferred embodiment of my invention, a portion is cooled and returned to the column in admixture with the overhead reflux stream, and the remainder is introduced into a fractionation column for the purpose of stripping the light naphtha hydrocarbons therefrom. These are returned to the main column through a locus below that through which the overhead reflux is returned and above that from which the heavy naphtha fraction was withdrawn. A heavy naphtha, principally containing hydrocarbons boiling from about 280° F. (138° C.) to about 450° F. (232° C.), is withdrawn as a bottoms product stream of the process.

In further describing the present inventive concept and the separation method encompassed thereby, reference will be made to the accompanying drawing which illustrates several embodiments. The drawing itself is presented by way of a simplified schematic flow diagram in which only the principal pieces of product separation equipment are shown. Details such as pumps and compressors, heaters and coolers, condensers, heat-exchangers and heat-recovery circuits, start-up lines, valving and similar hardware have been omitted as non-essential to a clear understanding of the techniques involved. The utilization of such miscellaneous appurtenances, to modify the process, is well within the purview of one skilled in the art, and will not remove the resulting process from the scope and spirit of the appended claims.

For the purpose of demonstrating the illustrated embodiments, the drawing will be described in conjunction with a commercially-scaled FCC system processing a vacuum gas oil charge stock. It is understood that the charge stock, stream compositions, operating conditions, design of fractionators, separators and the like are exemplary only, and may be varied widely without departure from the spirit of my invention.

DESCRIPTION OF DRAWING

When originally constructed, the effluent separation facility was designed for a reactor charge rate of 16,500 Bbl/day (109.23 $M^3$/hr.) and a conversion per pass of 55.0%. As a result of the need to increase the charge rate to 25,000 Bbl/day (165.5 $M^3$/hr.) and the conversion per pass to about 70.7%, there arose the necessity of revamping the fractionation section. Accomplishing this revamp is facilitated through the use of the present invention since the main column overhead system requires no change and no additional principal vessels need be supplied.

The vacuum gas oil charge stock has a gravity of about 24.7° API (0.9059 specific gravity), an average molecular weight of about 375 and contains about 1.9% by weight of sulfur. The charge stock is subjected to cracking reactions, in contact with a highly active zeolitic catalyst, at operating conditions including a combined feed ratio of 1.05, a raw oil temperature of about 700° F. (371° C.), a reactor temperature of about 940° F. (504° C.), a reactor pressure of about 30 psi. (2.11 kg/sq.cm.), a catalyst regenerator temperature of about 1160° F. (626° C.) and a regenerator pressure of about 35 psi. (2.46 kg/sq.cm.).

With specific reference now to the drawing, the product effluent from the reactor/regenerator section, in an amount of 336,358 lbs/hr. (42.47 kg/sec.) is introduced via line 1 at a temperature of about 925° F. (496° C.) and a pressure of 28 psi. (1.97 kg/sq.cm.) into main column 1 through a locus in the lower portion thereof. A catalyst-containing heavy slurry oil, in an amount of 486,366 lbs/ hr. (61.41 kg/sec) is withdrawn through line 3 at a temperature of 690° F. (365° C.). Since this bottoms material is being pumped elsewhere about 2,960 lbs/hr. (0.37 kg/ sec) of clarified oil is utilized as a pump flush stream to avoid malfunction. A portion of the slurry oil 400,908 lbs/hr. (50.62 kg/sec.) is diverted through line 4, utilized as a heat-exchange medium which lowers its temperature to about 450° F. (232° C.) and reintroduced into column 2 through a locus above the feed locus. The remaining 88,418 lbs/hr. (11.16 kg/sec.) of slurry oil continues through line 3, and is introduced into slurry settler 5 at a temperature of 690° F. (365° C.) and a pressure of about 90 psi. (6.33 kg/sq.cm.).

A common FCC operational technique constitutes introducing a relatively small portion of the charge stock into slurry settler 5. This is shown in the drawing where, of the total 330,416 lbs/hr. (41.72 kg/sec.) vacuum gas oil charge introduced via line 6, about 326,910 lbs. (41.28 kg/sec.) is diverted through line 7, the remainder (3,506 lbs.) (0.44 kg/sec.) continuing through line 6 into slurry settler 5. Of the total catalyst-containing slurry in line 3, 18,847 lbs/hr. (2.38 kg/sec.) of which about 347 lbs. (0.04 kg/sec.) are catalyst fines, is withdrawn from line 8, admixed with the bulk of the charge stock in line 7 and introduced into the reactor/regenerator section. Clarified oil, in an amount of 69,572 lbs/hr. (8.41 kg/sec.) through line 9, of which about 33,306 lbs. (4.22 kg/sec.) are diverted through line 44 and introduced thereby into main column 2. Of the remainder, 33,306 lbs. (15,107 kg) are recovered as a product and 2,960 lbs. (1,343 kg) used as a pump flush stream as aforesaid.

In the particular system being described, there is no separate recovery of a heavy cycle oil product; therefore, the cycle oil removed via line 10, 197,088 lbs/hr. (24.88 kg/sec.) at a temperature of about 560° F. (293 °C.), is utilized as a heat-exchange medium throughout other sections of the separation facility, and reintroduced into column 2, at a temperature of about 400° F. (204° C.), through line 11. As hereinbefore stated, excess heavy cycle oil is withdrawn in the slurry oil in line 3, and recovered in part with the clarified oil in line 9 and recycled in part to the reactor section via line 8.

A light cycle oil fraction, having a 90.0 volume percent distillation temperature of about 615°90 F. (324° C.) in the amount of 278,621 lbs/hr. (35.17 kg/sec.) is withdrawn through line 12 at a temperature of about 460° F. (238° C.). About 179,194 lbs. (22.63 kg/sec.) are diverted through line 16, employed as a heat-exchange medium and returned to the column at a temperature of about 256 F. (124° C.). The remaining 99,427 lbs/hr. (12.55 kg/sec.) continue through line 12 into LCO stripper 13 at a pressure of 22 psi. and a temperature of about 460° F. (238° C.). Steam, in the amount of about 3,044 lbs/hr. (0.38 kg/sec.) from line 45, is employed as the stripping medium, at temperature of about 350° F. (177° C.), to remove naphtha boiling range hydrocarbons; the light cycle oil product stream is recovered through line 14 in the amount of about 89,771 lbs/hr. (11.33 kg/sec.). The overhead stream from LCO stripper 13, containing 9,656 lbs/hr. (1.22 kg/sec.) of hydrocarbons, is returned to column 2 via line 15 at a temperature of about 450° F. (232° C.).

In accordance with the separation method of the present invention, the heavy naphtha concentrate, heretofore removed overhead in admixture with light naphtha hydrocarbons, is separately withdrawn as a side-cut through line 17. The temperature of this stream is 350° F. (177° C.) and the pressure is about 21 psi. (1.5 kg/sq.cm.). Of the 428,965 lbs/hr. (54.16 kg/sec.) removed, 354,605 lbs. (44.77 kg/sec.) are utilized as a heat-exchange medium in line 30 and ultimately returned to the main column via the reflux stream in line 29. The remaining 74,360 lbs. (9.39 kg/sec.) continue through line 17 into heavy naphtha stripper 18. Vessel 18 is referred to as a stripper since its principal function is to "strip" light naphtha hydrocarbons from the feed stream; in actuality, it functions as a fractionator. Of the 113,730 lbs/hr. (14.36 kg/sec.) removed as a bottoms stream through line 19, about 46,616 lbs. (5.89 kg/sec.) are diverted through line 20, increased in temperature to about 385° F. (196° C.) and reintroduced into the reboiler section of stripper 18; the remaining 67,114 lbs. (8.47 kg/sec.) continue through line 19, and are recovered as the heavy naphtha product stream. Overhead vapors from HN stripper 18, at a temperature of 355° F. (180° C.), in the amount of 7,246 lbs/hr. (0.91 kg/sec.) are returned to main column 2 via line 21.

Main column overhead vapors, in an amount of 180,679 lbs/hr. (22.81 kg/sec.) are condensed and introduced, via line 22, into low-pressure (20 psi.) (1.4 kg/sq. cm.) receiver 23 at a temperature of about 77° F. (25° C.) and a pressure of 15 psi. (1.1 kg/sq.cm.). These overhead vapors comprise 3,211 lbs. (0.41 kg/sec.) of inerts (flue gas), about 108 lbs. (0.01 kg/sec.) of hydrogen, 5440 lbs. (0.69 kg/sec.) of water and 171,920 lbs. (21.71 kg/sec.) of hydrocarbons. Water, in an amount of 5,011 lbs/hr. (0.63 kg/sec.) is removed through line 24 from dip-leg 25. Condensed hydrocarbonaceous material, in the amount of 107,334 lbs/hr. (13.55 kg/sec.) is removed from receiver 23 through line 27, and 29,834 lbs. (3.77 kg/sec.) are diverted through line 29, admixed with the 354,605 lbs/hr. (44.77 kg/sec.) of heavy naphtha recycle in line 30, and introduced into main column 2 as the overhead reflux stream. Uncondensed material, in the amount of 68,334 lbs/hr. (8.63 kg/sec.), is withdrawn through line 26, increased in pressure to a level of about 80 psi.

(5.62 kg/sq.cm.), condensed and introduced into high-pressure receiver 31 at a temperature of about 100° F. (38° C.). Condensed material, from receiver 23, not being refluxed to main column 2, about 77,500 lbs/hr. (9.79 kg/sec.), continues through line 27 into stabilizing column 28, being introduced at a temperature of about 190° F. (88° C.) and a pressure of about 125 psi. (8.8 kg/sq.cm.).

The material being introduced into receiver 31, 68,334 lbs/hr. (8.63 kg/sec.) consists of 3,177 lbs. (0.40 kg/sec.) of inerts (mainly carbon oxides), 108 lbs. (0.01 kg/sec.) of hydrogen, 429 lbs. (0.05 kg/sec.) of water and 64,620 lbs. (8.16 kg/sec.) of hydrocarbons. Water is withdrawn through line 32, from dip-leg 33, in the amount of 160 lbs/hr. (0.02 kg/sec.); 13,018 lbs/hr. (1.64 kg/sec.) of hydrocarbons are recovered in line 34, admixed with the condensed material in line 27 and introduced therewith into stabilizer 28; and, vaporous material, in the amount of 55,156 lbs/hr. (6.96 kg/sec.), is transported via line 35 to suitable recovery facilities.

The total quantity of material introduced into stabilizer 28, via line 27, is 90,518 lbs/hr. (11.43 kg/sec.). Overhead vapors, in the amount of 38,692 lbs/hr. (4.89 kg/sec.) are withdrawn through line 38 at a temperature of about 126° F. (52° C.) and a pressure of about 120 psi. (8.4 kg/sq.cm.). These are condensed and introduced into receiver 39 at a temperature of about 102° F. (39° C.). Condensed material, in the amount of 31,673 lbs/hr. (4.0 kg/sec.) is employed as overhead reflux via line 42, and 7,019 lbs/hr. (0.89 kg/sec.) of vapor are recovered via line 43, combined with the vapors in line 35 and transported therewith to the recovery facility. Since the feed stream to stabilizer 28 contains a minimal amount of water, the same is recovered via line 40 and dip-leg 41 on a periodic basis. Bottoms liquid, in the amount of 142,846 lbs/hr. (18.04 kg/sec.) is recovered via line 36. Of this amount, 59,347 lbs. (7.49 kg/sec.) are diverted through line 37, increased in temperature to a level of about 260° F. (127° C.) and utilized to supply heat to the reboiler section of the stabilizer. The remaining 83,499 lbs/hr. (10.54 kg/sec.) continue through line 36 and are recovered as the light naphtha product.

The foregoing clearly illustrates the method of effecting the present invention, the benefits of which have been hereinbefore set forth.

I claim as my invention:

1. In a fluid catalytic cracking process, wherein a hydrocarbonaceous charge stock is converted into lower-boiling hydrocarbons in contact with finely-divided catalyst particles, the method of separating catalyst-containing, catalytically-cracked product effluent which comprises the steps of:

a. introducing said product effluent into a first fractionation column through a first locus in the bottom portion thereof;

b. withdrawing a light naphtha fraction from a second locus in the upper portion of said column, condensing and separating said light naphtha fraction to provide (i) a first vaporous phase and, (ii) a liquid phase;

c. recycling a first portion of said liquid phase, as a reflux stream, to said first column through a third locus below said second locus, and introducing a second portion into a second fractionation column;

d. separating said second portion to provide (i) a second vaporous phase and, (ii) a light naphtha product stream;

e. withdrawing a heavy naphtha fraction from said first column, through a fourth locus below said third locus, and introducing at least a portion thereof into a third fractionation column;

f. separating the portion of said heavy naphtha fraction to provide (i) a heavy naphtha bottoms product stream substantially free from light naphtha and, (ii) a light naphtha containing overhead stream;

g. introducing at least a portion of said overhead stream into said first column through a fifth locus intermediate said third and fourth loci; and, h. withdrawing a catalyst-containing slurry oil fraction from said first column through a sixth locus below said first locus.

2. The method of claim 1 further characterized in that a portion of said withdrawn heavy naphtha fraction is cooled and combined with said reflux stream for introduction into said first column through said third locus.

3. The method of claim 1 further characterized in that said first vaporous phase is separated, at an elevated pressure, to provide (i) a third vaporous phase and, (ii) a second liquid phase.

4. The method of claim 3 further characterized in that said second liquid phase is introduced into said second fractionation column.

5. The method of claim 1 further characterized in that said second vaporous phase is condensed and separated to provide (i) a third liquid phase and, (ii) a fourth vaporous phase, and at least a portion of said third liquid phase is recycled to said second fractionation column as a reflux stream.

6. The method of claim 1 further characterized in that a light cycle oil fraction, containing heavy naphtha, is withdrawn from said first fractionation column through a seventh locus below said fourth locus, said heavy naphtha is separated therefrom and returned to said first fractionation column through an eighth locus intermediate said fourth and seventh loci.

7. The method of claim 6 further characterized in that a portion of said heavy naphtha-containing light cycle oil fraction is cooled and returned to said first fractionation column through a ninth locus intermediate said fourth and eighth loci.

* * * * *